United States Patent [19]

Lenzing et al.

[11] Patent Number: 5,032,816

[45] Date of Patent: Jul. 16, 1991

[54] LONGITUDINALLY CONTOURED CONDUCTOR FOR INDUCTIVE ELECTRICAL DEVICES

[75] Inventors: Richard S. Lenzing, Farmington; Julian A. Watt, Falls Village, both of Conn.

[73] Assignee: The Superior Electric Company, Bristol, Conn.

[21] Appl. No.: 430,937

[22] Filed: Nov. 2, 1989

Related U.S. Application Data

[63] Continuation of Ser. No. 201,342, May 27, 1988, abandoned, which is a continuation-in-part of Ser. No. 900,118, Aug. 25, 1986, abandoned.

[51] Int. Cl.[5] ..... H01F 29/06; H01F 27/28

[52] U.S. Cl. ..... 336/141; 336/223

[58] Field of Search ..... 336/223, 69, 70, 222, 336/225, 139, 140, 141, 210; 318/141; 334/75

[56] References Cited

U.S. PATENT DOCUMENTS

| | | | |
|---|---|---|---|
| 719,005 | 1/1903 | Hogg | 336/223 X |
| 854,774 | 5/1907 | Taylor | 336/223 |
| 1,000,440 | 8/1911 | Reeves | 336/223 X |
| 1,738,528 | 12/1929 | Dunlop | 336/223 X |
| 2,395,062 | 2/1946 | Nielson | 336/223 X |
| 2,496,034 | 1/1950 | Blancha | 336/141 |
| 2,604,519 | 7/1952 | Mackereth | 336/223 X |
| 2,735,072 | 2/1956 | Versoy, Jr. | 334/75 X |
| 2,735,075 | 2/1956 | Thomason | 336/223 X |
| 2,735,979 | 2/1956 | Coben | 336/223 X |
| 2,873,373 | 2/1959 | Lyman et al. | 334/75 X |
| 2,963,669 | 12/1960 | Salisbury | 336/223 X |
| 3,140,458 | 7/1964 | Willecke | 336/223 X |
| 3,480,897 | 11/1969 | Helbene et al. | 336/149 |
| 3,731,243 | 5/1973 | Davis | 336/223 X |
| 4,429,206 | 1/1984 | Kothmann | 336/223 X |

FOREIGN PATENT DOCUMENTS

| | | | |
|---|---|---|---|
| 521287 | 7/1953 | Belgium | 334/75 |
| 1240932 | 5/1967 | Fed. Rep. of Germany | 336/210 |
| 811392 | 12/1935 | France | 336/141 |
| 70945 | 1/1970 | German Democratic Rep. | 336/223 |
| 718748 | 11/1954 | United Kingdom | 336/223 |

*Primary Examiner*—Thomas J. Kozma
*Attorney, Agent, or Firm*—John H. Crozier

[57] ABSTRACT

An improved conductor for an inductor device of the type having varying current carrying requirements along the length of the conductor, the improvement comprising having the conductor contoured such that the cross sectional area of the conductor varies substantially directly as the current carrying requirements of the conductor vary. In one embodiment, a coil for a variable transformer is cut from a cylinder of conductor material by numerically controlled machining, producing a contoured conductor and eliminating the requirement for coiling or winding of the conductor.

4 Claims, 5 Drawing Sheets

LONGITUDINALLY CONTOURED CONDUCTOR FOR INDUCTIVE ELECTRICAL DEVICES

This is a continuation of co-pending application Ser. No. 07/201,342 filed on May 27, 1988, now abandoned, which is a continuation-in-part of application Ser. No. 06/900,118, filed Aug. 25, 1986, abandoned.

BACKGROUND OF THE INVENTION

1. Field of the Invention

The present invention is related to inductive electrical devices in which there is a varying current density, and more particularly to a longitudinally contoured conductor for such devices which minimizes the quantity of required conductor material.

2. Background Art

Inductive electrical devices are well known and widely used in electrical systems as energy transfer or storage elements and include, for example, variable transformers and certain types of choke coils and reactors in which a coiled conductor induces a voltage in itself or another coil, frequently in association with a paramagnetic flux-carrying material.

The conductors of such devices are typically formed of round, rectangular, or square conductors with the conductor in any such device having a uniform cross section substantially throughout its length. The current handling requirements in a conductors in such devices may change with respect to the position in the conductor; however, by using constant cross-section conductors, the coils are designed to withstand the maximum currents throughout the coil when, in actuality, only certain portions of the coil carry the maximum currents. This conventional configuration wastes conductor material and results in a device that is heavier and larger than need be for the current carried.

SUMMARY OF THE INVENTION

The present invention overcomes the above limitations of conventional devices by providing a coil for an inductive device that is longitudinally contoured so that it has maximum cross sectional area in those sections where maximum current is carried and lesser cross sectional areas, proportional to the current carried, in other sections of the coil. A suggested method of producing such a coil also results in a greatly simplified manufacturing process.

BRIEF DESCRIPTION OF THE DRAWING

FIGS. 4(*a*), (*b*), and (*c*) are cross-sectional views of coil turns, according to the present invention.

DESCRIPTION OF THE PREFERRED EMBODIMENT

Figure 1:
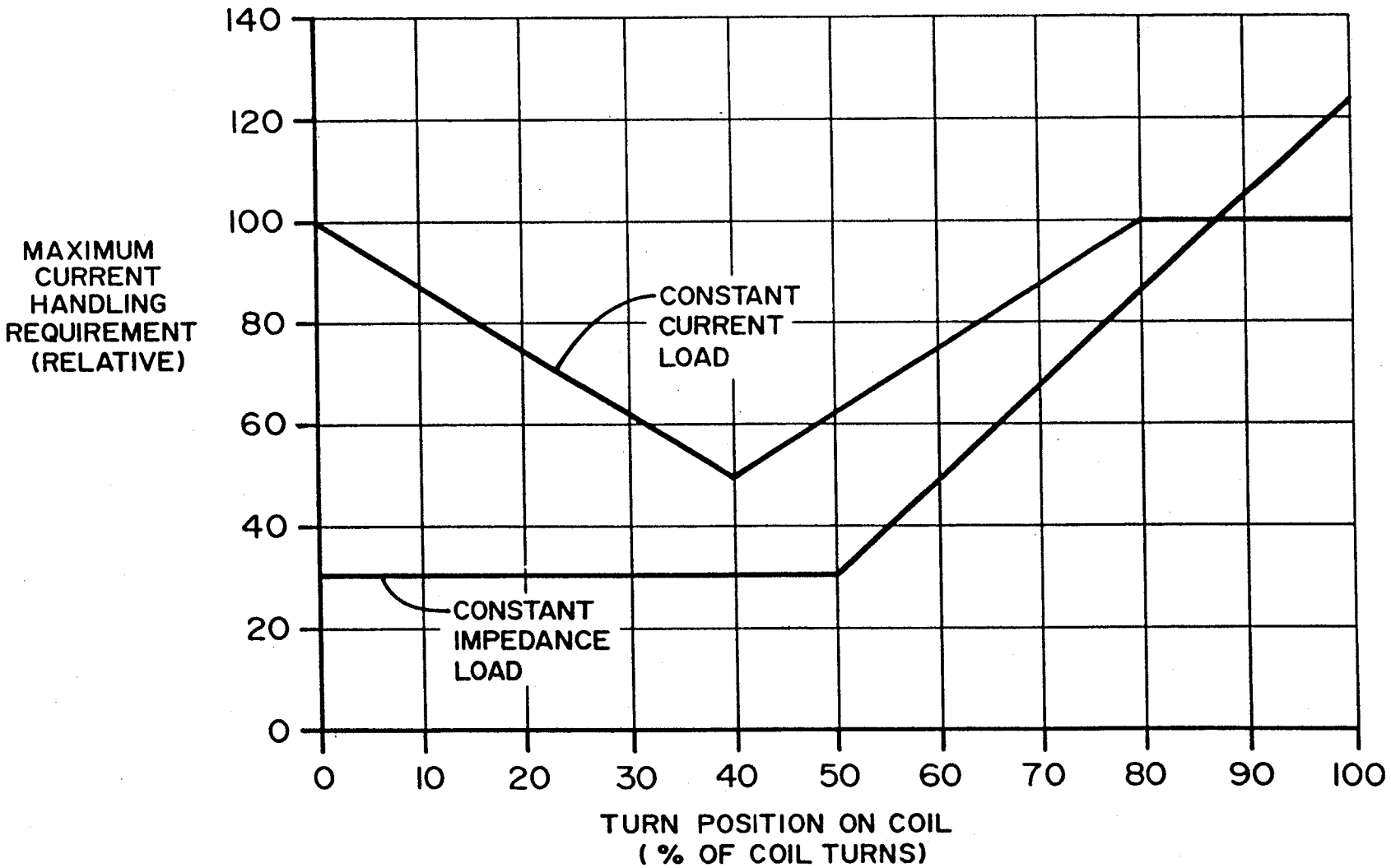
FIG. 1 is a graph of current versus coil position for a typical variable transformer.

Referring to the Drawing, FIG. 1 is a graph, for a typical variable transformer, of the maximum current handling requirement of the transformer coil versus the turn position on the coil. Curves are shown for both constant current load operation and constant impedance load operation. For constant current load operation, it is seen that, at the beginning of the coil, the current is at its maximum, drops to about one-half of maximum, and then rises to and remains at maximum along the last 20 percent of the coil. For constant impedance load operation, the current is at a low level along the first half of the coil and then rises along the rest of the coil.

Figure 2:
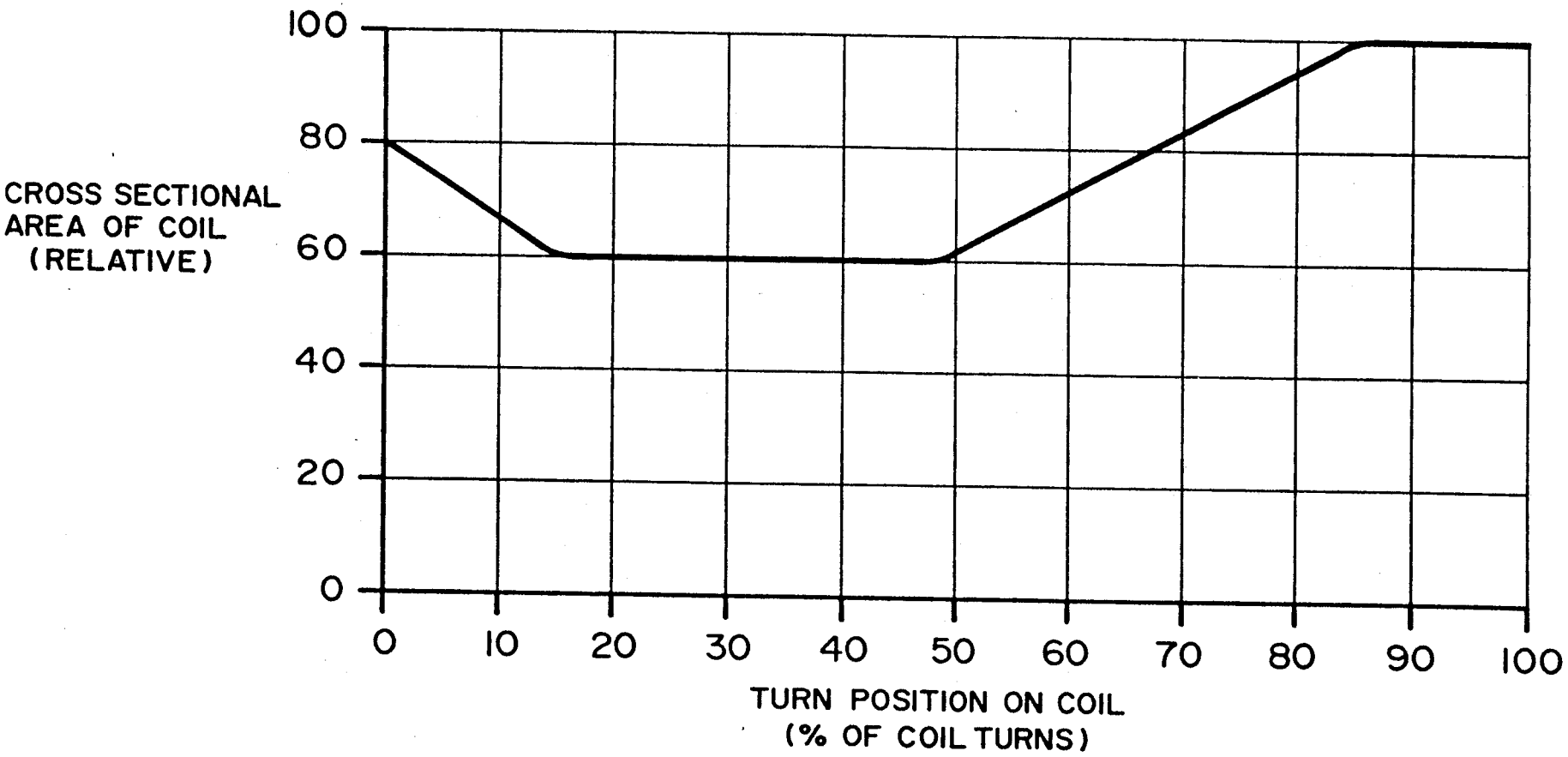
FIG. 2 is a graph showing an improved coil cross sectional area for the variable transformer of FIG. 1 according to the present invention.

FIG. 2 shows how a coil might be contoured, in accordance with the present invention, for the transformer requirements shown on FIG. 1. The contouring indicated satisfies the requirements for both constant current and constant impedance load conditions. At the beginning of the coil, the cross sectional area is relatively large to handle constant current load conditions, drops to a lower level when the current is relatively low under either load condition, and then rises to its maximum toward the end of the coil to handle the maximum current under constant impedance load operation.

Figure 3:
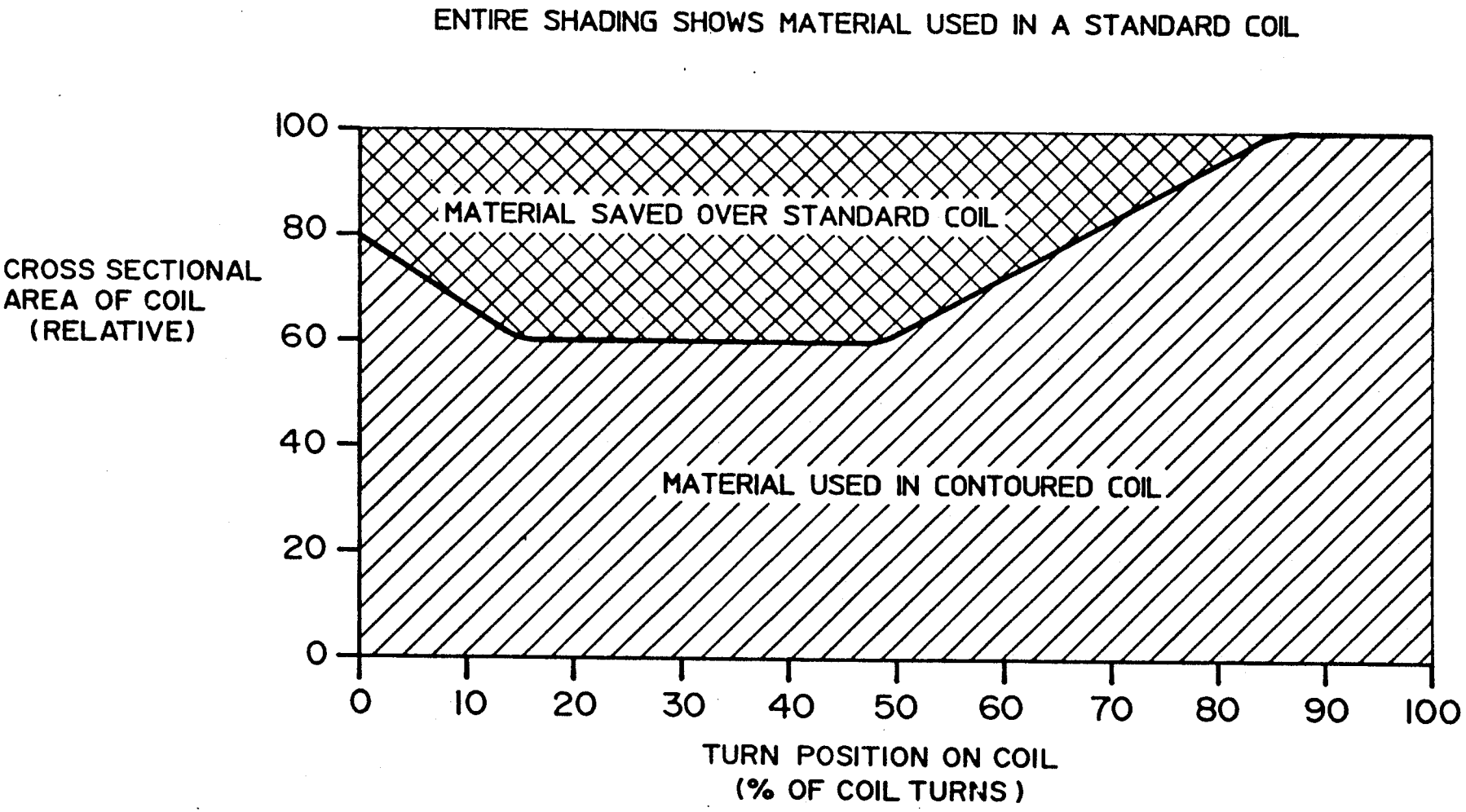
FIG. 3 shows material used and saved over conventional construction in the variable transformer of FIG. 2.

FIG. 3 is FIG. 2 shaded to show coil material saved by the present invention over conventional construction. For the design under consideration, there is a savings of about 20 percent in coil material.

Figure 4:
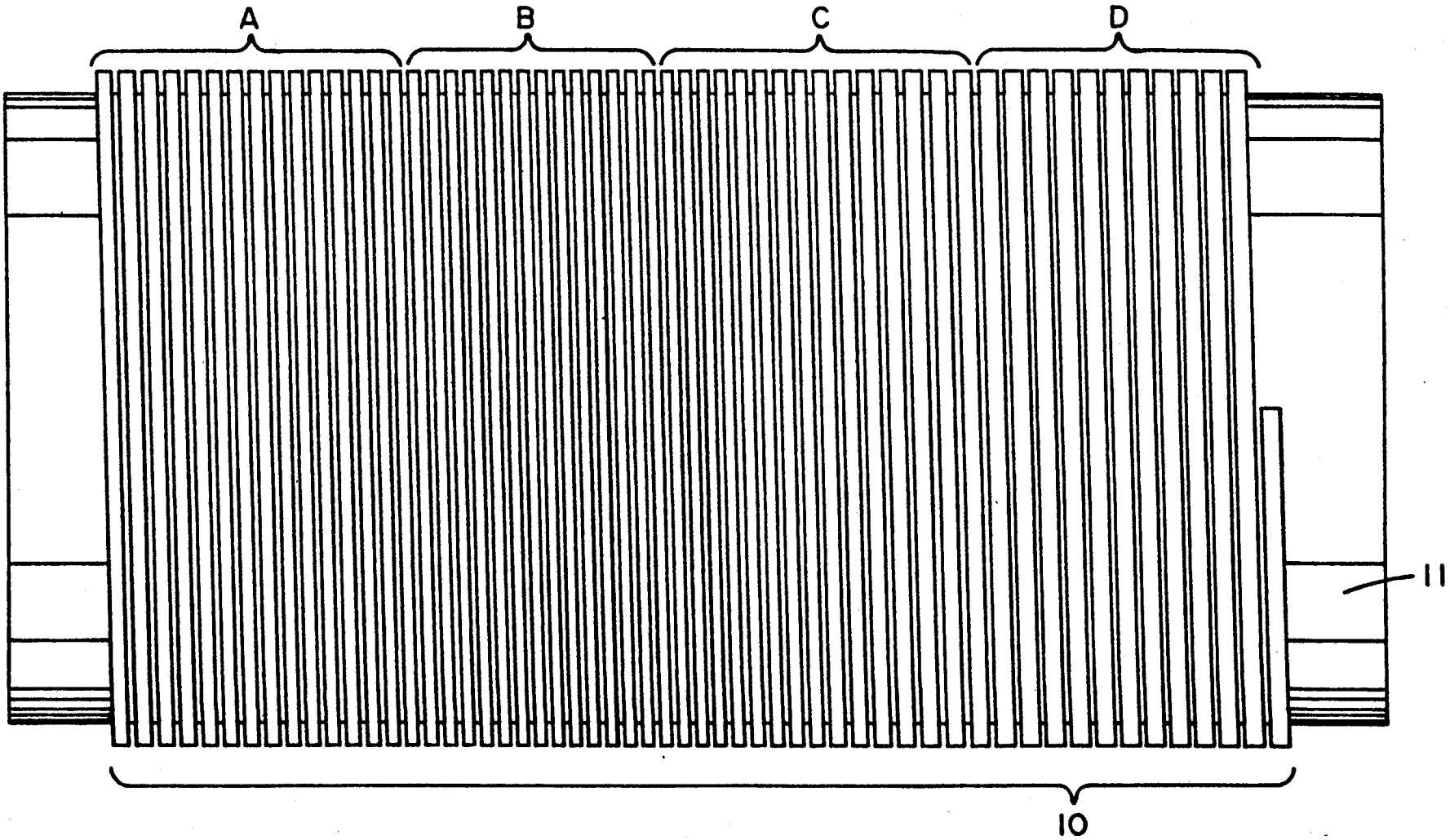
FIG. 4 is a view of a coil constructed according to the present invention.
Figure 4A:
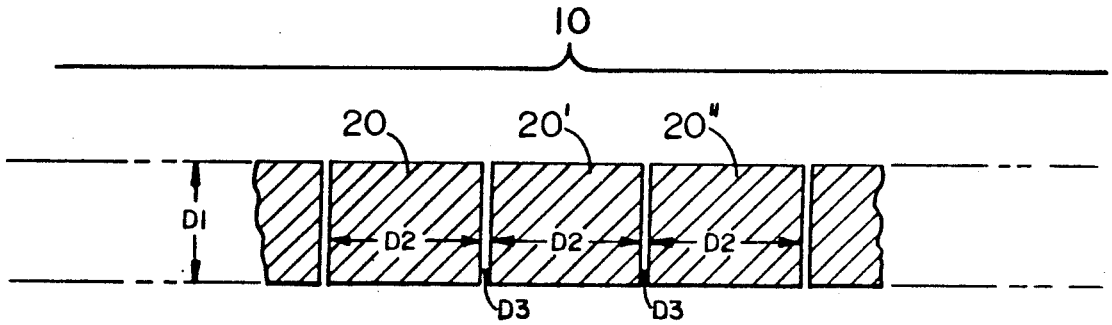
Figure 4B:
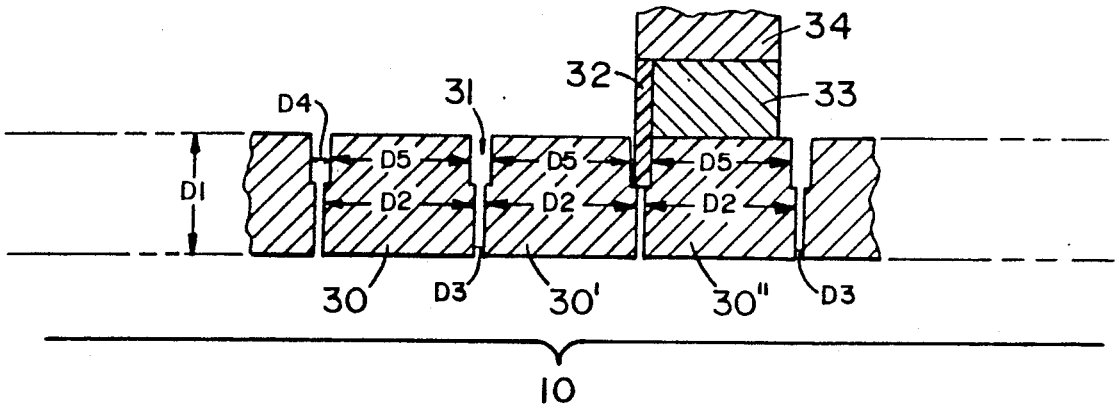
Figure 4C:
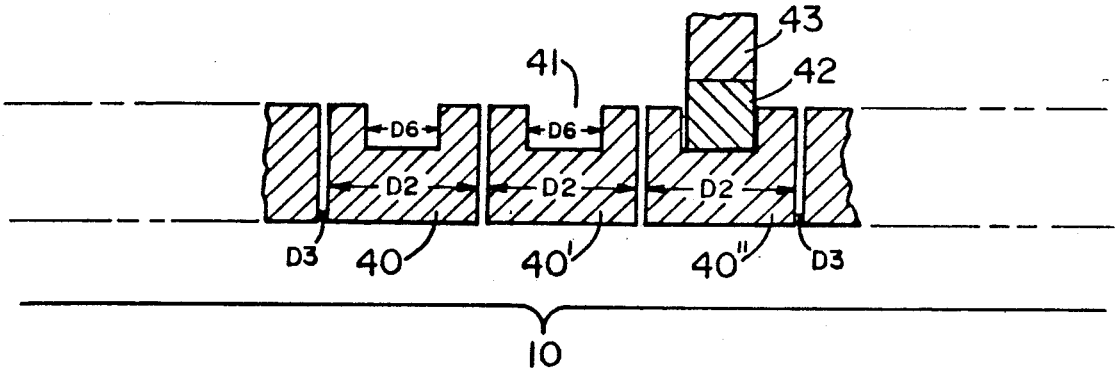

FIG. 4 shows a coil constructed according to the present invention and includes a conductor 10 on the surface of a tube of insulating material 11. Beginning at the left end of the coil 10, section "A" begins with relatively wide coil turns decreasing to the minimum width section "B". The width of the coil turns increases through section "C" to the maximum width coil turns in section "D" at the right end of the coil 10. The contouring is substantially as shown on FIG. 2.

The coil 10 may be cut from a solid tube of electrical grade copper. Prior to cutting the contoured turns, the coil is stabilized by threading the inside diameter of the copper tube, screwing it onto the outside diameter of a threaded tube of the insulating material 11, and bonding these two pieces together. The bonding may be achieved by vacuum impregnating the assembly with transformer varnish, thus thoroughly stabilizing the future coil. After this stabilization process has been completed, the coil is cut from the copper tube by numerically controlled machining. Numerically controlled machining can easily vary the pitch of the cuts made through the copper tube, thus achieving the desired coil conductor width variances through simple numerically controlled programming.

The completed coil, stabilized on the insulating tube, requires very little finish machining. The procedure also allows an accurate brush guide to be easily machined into the coil, if the coil is of the type requiring a contact brush.

In addition to having an economical coil, another advantage to the present invention is in eliminating complicated manufacturing processes and costly tooling. Specifically, it eliminates the need for winding-/coiling rectangular or square wire and the complicated process of accurately positioning and stabilizing turns of the transformer's coil.

While the present invention has been described as applied to a conductor in the form of a cylindrical helix, it will be understood that it is applicable to other inductor devices with other shapes of conductors such as toroids. It will also be understood that it is not necessary that the coil be mounted on an insulating tube.

FIG. 4(*a*) is a cross-sectional view of adjacent coil turns 20, 20', and 20'' of the coil 10, shown in one preferred embodiment, with each coil turn having a rectangular cross-section. Dimension D1, the thickness of a coil turn is constant and dimension D2, the width of a coil turn is variable, in accordance with the present invention, while dimension D3, the spacing between two adjacent coil turns, is preferably constant and sized depending on the maximum coil turn-to-coil turn voltage drop in the coil 10. Having dimension D3 constant simplifies the machining process, but having that dimension constant is not necessary for the practicing of the present invention.

FIG. 4(*b*) is a cross-sectional view of adjacent coil turns 30, 30', and 30'' of the coil 10, shown in another preferred embodiment, in which the coil turns have formed therebetween a brush guide groove 31. The outer periphery of the coil 10 is at the top of the figure. The brush guide groove 31 is formed by removing a segment of each of two adjacent coil turns, such as the coil turns 30 and 30' so as to form the groove to slidingly accommodate a nonconducting brush guide 32 therein. Dimension D4, the width of the brush guide groove 31, is preferably constant throughout the length of the coil 10. The brush guide 32, a contact brush 33, and a brush holder 34 are mutually fixedly attached. The contact brush 33 bears against the outer periphery of the coil turns for electrical contact. In the preferred embodiment shown, dimension D5 is variable and the width of the brush 33 is dimensioned such that it approximates the smallest D5 dimension. The brush guide groove could also be formed by removing a segment of only one edge of each coil turn of the coil 10.

With a typical coil turn 30 having a thickness dimension, D1, on the order of about $\frac{3}{4}$ inch, dimension D4 might be on the order of about $\frac{1}{8}$ inch and dimension D3 might be on the order of about 0.03-inch, while the depth of the groove 31 might be on the order of about $\frac{1}{4}$ inch. Having the stepped configuration resulting from the relative values of dimension D4 and dimension D3 permits dimension D3 to be machined with a relatively narrow tool, without requiring that such narrow tool have a length as great as the dimension D1 of the coil turn. While these approximate values of the dimensions are preferable for one construction according to the present invention, other values may be suitable, as well, depending on the level of current carried in the coil 10 and other factors. Also, it is not necessary that the cross-sectional shape of the groove 31 be rectangular, but the groove may have other configurations if desired.

FIG. 4(*c*) shows another preferred embodiment of the present invention in which a guide groove 41, preferably having a constant dimension D6, is provided in the outer peripheral surface of each of adjacent coil turns 40, 40', and 40'' to accommodate a contact brush 42 that is fixedly attached to a brush holder 43. In this embodiment, the contact brush 42 serves as its own guide, thus simplifying the construction. A further advantage of this embodiment is that a relatively large brush-to-coil turn contact surface may be provided, thus extending the life of the brush.

While the preferred cross-sectional shapes of individual turns of the coil 10 are generally rectangular, for reasons of economy, any of a number of cross-sectional shapes may be provided within the intent of the present invention.

It will be understood that what has been disclosed is a novel current conductor for inductor devices of the type having varying current densities along the conductor, the conductor having a contoured cross section such that the cross sectional area of the conductor varies substantially directly as the current carrying requirements of the conductor vary.

Since certain changes may be made in carrying out the above invention without departing from the scope thereof, it is intended that all matter contained in the above description or shown in the accompanying drawing shall be interpreted as illustrative and not in a limiting sense.

It is also intended that the following claims are intended to cover all of the generic and specific features of the invention herein described, and all statements of the scope of the invention which, as a matter of language, might be said to fall therebetween.

We claim:

1. A conductor for carrying current in a transformer of the type having varying current carrying requirements along the length of the conductor, comprising:

(a) the conductor having a rectangular cross section of uniform thickness;

(b) the cross sectional area of at least a portion of the conductor varies continuously and that cross sectional area of that portion of the conductor varies substantially directly as the current carrying requirements of the conductor vary in that portion;

(c) a contact brush guide groove of constant width machined in the conductor; and (d) a contact brush disposed for movement along the contact brush guide groove.

2. Claim 1, further comprising a contact brush guide with the contact brush mounted thereon, disposed for contacting movement with the contact brush guide groove.

3. A conductor for carrying current in a transformer of the type having varying current carrying requirements along the length of the conductor, comprising:

(a) the conductor having a rectangular cross section and a uniform thickness;

(b) the conductor having at least first and second lengths, the first and second lengths having different cross-sectional areas substantially proportional to the amount of current required to be carried by each;

(c) a transitional length of conductor connecting the first and second lengths and having a continuously varying cross sectional area, the varying cross sectional area being substantially proportional to the varying amount of current to be carried by the transitional length of conductor;

(d) a contact brush guide groove of constant width machined therein; and (e) a contact brush disposed for movement along the contact brush guide groove.

4. Claim 3, further comprising a contact brush guide with the contact brush mounted thereon, disposed for contacting movement with the contact brush guide groove.

* * * * *